US012428192B2

(12) United States Patent
Reinhart et al.

(10) Patent No.: US 12,428,192 B2
(45) **Date of Patent: *Sep. 30, 2025**

(54) BASE WALL SUPPORT FOR TOTE

(71) Applicant: CREATIVE PLASTIC CONCEPTS, LLC, Sycamore, OH (US)

(72) Inventors: Nickolas Reinhart, Sarasota, FL (US); Jacob H. Whitta, Bluffton, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/489,120

(22) Filed: Oct. 18, 2023

(65) Prior Publication Data

US 2024/0043161 A1 Feb. 8, 2024

Related U.S. Application Data

(63) Continuation of application No. 16/943,686, filed on Jul. 30, 2020, now Pat. No. 11,827,412.

(60) Provisional application No. 62/880,142, filed on Jul. 30, 2019.

(51) Int. Cl.
*B65D 1/44* (2006.01)
*B65D 1/22* (2006.01)

(52) U.S. Cl.
CPC *B65D 1/44* (2013.01); *B65D 1/22* (2013.01)

(58) Field of Classification Search
CPC ... B65D 1/44; B65D 1/22; B65D 1/42; B65D 1/34; B65D 11/22; B65D 11/24; B65D 11/10
USPC ..... 220/608, 623, 607, 628, 637, 635, 636, 220/675, 674
See application file for complete search history.

(56) References Cited

U.S. PATENT DOCUMENTS

| | | | | | |
|---|---|---|---|---|---|
| 1,404,154 | A * | 1/1922 | Lee | B65D 7/08 | 220/DIG. 2 |
| 1,957,639 | A * | 5/1934 | Goodwin | B65D 7/46 | 220/623 |
| 3,286,877 | A * | 11/1966 | Haimes | B65D 1/38 | 220/675 |
| 3,583,623 | A * | 6/1971 | Golner | B65D 1/34 | D9/425 |
| 3,863,833 | A * | 2/1975 | Swett | A47J 47/02 | 229/5.5 |
| 3,870,188 | A * | 3/1975 | Buffett | B65D 1/22 | 220/675 |
| D643,717 | S | 8/2011 | Reinhart et al. | | |
| D648,535 | S | 11/2011 | Reinhart et al. | | |
| D743,171 | S | 11/2015 | Reinhart | | |
| D744,240 | S | 12/2015 | Reinhart | | |
| D756,652 | S | 5/2016 | Reinhart | | |

(Continued)

*Primary Examiner* — Robert Poon
(74) *Attorney, Agent, or Firm* — Thompson Coburn LLP

(57) ABSTRACT

A storage tote includes a main body with a base wall and a plurality of side walls. The base wall has a center area, a central ridge, a first side ridge, and a second side ridge. The center area is bounded by the plurality of side walls. The central ridge bisects the base wall. In addition, the central ridge has a first wall, a second wall, and a third wall. The first side ridge and the second side ridge are disposed across the center area and oriented parallel to the central ridge. The first side ridge is spaced apart from the first wall of the central ridge, while the second side ridge is spaced apart from the second wall of the central ridge.

1 Claim, 6 Drawing Sheets

(56) References Cited

U.S. PATENT DOCUMENTS

| | | | | |
|---|---|---|---|---|
| D768,385 | S | 10/2016 | Reinhart | |
| D781,586 | S | 3/2017 | Reinhart | |
| D790,858 | S | 7/2017 | Reinhart | |
| D794,958 | S | 8/2017 | Reinhart | |
| D834,315 | S | 11/2018 | Reinhart | |
| D881,576 | S | 4/2020 | Reinhart et al. | |
| 10,899,499 | B2 | 1/2021 | Reinhart et al. | |
| D910,312 | S | 2/2021 | Reinhart et al. | |
| D912,984 | S | 3/2021 | Reinhart et al. | |
| D932,188 | S | 10/2021 | Reinhart et al. | |
| 11,220,376 | B2 | 1/2022 | Reinhart | |
| 11,390,307 | B2 | 7/2022 | Reinhart et al. | |
| 11,440,723 | B2 | 9/2022 | Reinhart et al. | |
| 11,548,685 | B2 | 1/2023 | Reinhart et al. | |
| 11,618,610 | B2 | 4/2023 | Whitta et al. | |
| 11,827,412 | B2 * | 11/2023 | Reinhart | B65D 1/22 |
| 2010/0025284 | A1 * | 2/2010 | Oohori | B65D 1/34 220/639 |
| 2010/0297310 | A1 * | 11/2010 | Garbe | B65D 85/72 426/128 |
| 2021/0031964 | A1 | 2/2021 | Reinhart et al. | |
| 2022/0119166 | A1 | 4/2022 | Reinhart | |
| 2023/0100589 | A1 | 3/2023 | Whitta et al. | |
| 2023/0142041 | A1 | 5/2023 | Whitta et al. | |
| 2024/0010381 | A1 | 1/2024 | Whitta et al. | |

* cited by examiner

BASE WALL SUPPORT FOR TOTE

CROSS REFERENCE TO RELATED APPLICATIONS

This application is a continuation of U.S. patent application Ser. No. 16/943,686 filed on Jul. 30, 2020, which claims priority to U.S. Provisional Patent Application Ser. No. 62/880,142 filed on Jul. 30, 2019. The entire disclosure of the above application is hereby incorporated herein by reference.

FIELD

The present disclosure relates to containers and, more particularly, to plastic storage totes.

BACKGROUND

In recent years, consumers have become more concerned with the aesthetic appearance and functionality of garages, basements, closets, sheds, and other areas in which items tend to accumulate. As a result, consumers have invested vast sums of money on totes to store and organize accumulated items. A vast majority of such totes are plastic and formed by an injectional molding process.

It is known that plastic totes can undesirably become warped due to the pressure and stress exerted on them during the injection molding process, when the molten plastic is injected at high temperatures into a mold. This pressure and stress, and the associated warping, is especially problematic for base walls of plastic totes. This warping of the base wall impacts not only the appearance of the totes, but also the ability to stack and store totes in transport and on shelves.

There is a continuing need for a storage tote that has a resistance to the pressure and stress exerted on the storage tote during the injection molding process. Desirably, the storage tote in particular has a base wall that militates against warping and deflection.

SUMMARY

In concordance with the instant disclosure, a storage tote that has a resistance to the pressure and stress exerted on the storage tote during the injection molding process, and which has a base wall in particular that militates against warping and deflection, has been surprisingly discovered.

In one embodiment, a storage tote that is resistant to stress and militates against warping includes a main body which has a base wall and a plurality of side walls. The plurality of side walls may include a first side wall and a second side wall. The base wall may have a center area generally arranged on a first plane. The center area may be bound by the plurality of side walls. The center area of the base wall may further include a central ridge with a first end and a second end. The first end of the central ridge may be disposed adjacent to the first side wall of the storage tote. The second end of the central ridge may be disposed adjacent to the second side wall of the storage tote. The central ridge may bisect the base wall.

In another embodiment, the storage tote may include a main body which has a base wall and a plurality of side walls. The plurality of side walls may include a first side wall and a second side wall. The base wall may have a center area generally arranged on a first plane. The center area may be bound by the plurality of side walls. The center area of the base wall may further have a central ridge and an outer perimeter ridge. The central ridge further may have a first end and a second end. The center area of the base wall may have a first side ridge and a second side ridge. The first end of the central ridge may be connected to the outer perimeter ridge and disposed adjacent to the first side wall of the storage tote. The second end of the central ridge may be connected to the outer perimeter ridge and disposed adjacent to the second side wall of the storage tote. The central ridge may bisect the base wall and may be disposed between the first side ridge and the second side ridge.

In an alternative embodiment, the storage tote includes a main body having a base wall and a plurality of side walls. The plurality of sidewalls may include a first sidewall, a second side wall, a third side wall, and a fourth sidewall. The base wall may have a center area generally arranged on a first plane. The center area may be bound by the plurality of side walls. The center area of the base wall may further have a central ridge with a first end and a second end. The first end of the central ridge may be disposed adjacent to the first side wall of the storage tote. The second end of the central ridge may be disposed adjacent to the second side wall of the storage tote. The central ridge may bisect the main body. The center area of the base wall may have a first side ridge and a second side ridge. The central ridge may have a first wall, a second wall, and a third wall. The first wall may be disposed on a second plane oriented transverse to the first plane. The second wall may be spaced apart from the first wall. The second wall may be oriented on a plane generally parallel with the second plane. The third wall of the central ridge may be disposed on a third plane oriented transverse to the second plane. The third wall may be disposed between and may be connected to the first wall and the second wall of the central ridge. The first side ridge may be spaced apart from the first wall of the central ridge. The second side ridge may be spaced apart from the second wall of the central ridge. The first side ridge may further include a central portion and a pair of first end portions. The central portion of the first side ridge may be spaced apart from the first side of the central ridge. The central portion of the first side ridge may be oriented substantially parallel to the central ridge. The second side ridge may further include a central portion and a pair of second end portions. The central portion of the second side ridge may be spaced apart from the second side of the central ridge. The central portion of the second side ridge may be oriented substantially parallel to the central ridge. Each of the first end portions and the second end portions may be oriented transverse to the central ridge.

In an exemplary embodiment, the storage tote includes a main body with a base wall and a plurality of side walls. The base wall has a center area, a central ridge, a first side ridge, and a second side ridge. The center area is bounded by the plurality of side walls. The central ridge has a first side and a second side. The central ridge may be formed by two adjacent channels formed in the base wall, for example, via an injection molding process.

In a particular example, the central ridge may be disposed and oriented across the base wall so that it bisects the base wall. The first side ridge may be disposed across the center area. In a more particular example, the first side ridge may be spaced apart from the first side of the central ridge and oriented parallel to the central ridge. The first side ridge may be formed by two adjacent channels via injection molding or any other appropriate method.

In another embodiment, the second side ridge may be disposed across the center area and spaced apart from the second side of the central ridge. The second side ridge may be oriented parallel to the central ridge. The second side ridge may be formed by two adjacent channels via injection molding or any other appropriate method.

In an alternative embodiment, the first side ridge may only have a center portion that is oriented parallel to the central ridge. Similarly, the second side ridge may only have a center portion that is oriented parallel to the central ridge. The first side ridge and the second side ridge may further include a plurality of end portions oriented transverse to the central ridge.

Without being bound to any particular theory, it is believed that the positioning and the wide width of the ridges, and their associated channels in the abovementioned and following embodiments, allow the base wall of storage tote to have more structural integrity. This arrangement of the ridges provides a "corrugated" effect that is also believed to contribute to the superior structural integrity. This greater structural integrity of the base wall allows the pressure and stress during the manufacturing process to be more evenly distributed along the base wall, for example, in a manner similar to a structural Roman arch. By evenly distributing the stress along the base wall, the storage tote is more resistant to warping following the injection molding process. Likewise, this allows the storage tote to have a more consistent appearance after the manufacturing process and enhances the stacking quality of the storage tote.

The effects of these improvements have been demonstrated in a computer analysis of a prior art storage tote being subjected to an injection pressure during a molding process. The prior art storage tote exhibits significant warping in the center area of the base wall, as shown by the plastic flexing inward by almost 0.16 inches (4 millimeters). By comparison, and as described further herein, the embodiments of the storage tote in the present disclosure drastically reduces the inward flexing on the center area and more evenly distributes the stress across the main body.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
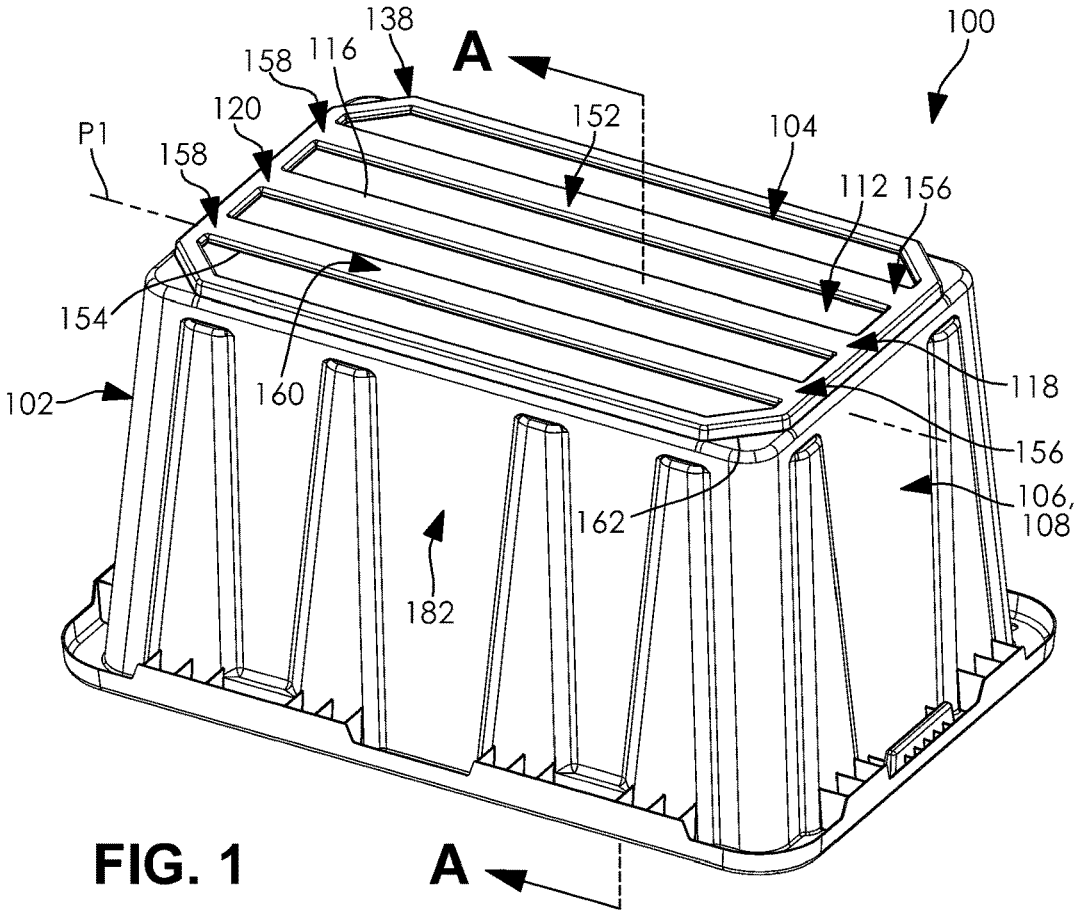
FIG. 1 is a bottom perspective view of a storage tote according to one embodiment of the present disclosure.

The following detailed description and appended drawings describe and illustrate various embodiments of the invention. The description and drawings serve to enable one skilled in the art to make and use the invention, and are not intended to limit the scope of the invention in any manner.

As shown in FIGS. 1-8 and 12-15, a storage tote 100 according to the present disclosure includes a main body 102 that is resistant to pressure and stress associated with the injection molding process, and which militates against warping. The main body 102 has a base wall 104 and a plurality of side walls 106. The plurality of side walls 106 includes a first side wall 108 and a second side wall 110.

The base wall 104 has a center area 112 generally arranged on a first plane P1. The center area 112 of the base wall 104 is bounded by the plurality of side walls 106. The center area 112 of the base wall 104 further includes a central ridge 116 with a first end 118 and a second end 120. The first end 118 of the central ridge 116 may be disposed adjacent to the first side wall 108 of the storage tote 100. The second end 120 of the central ridge 116 may be disposed adjacent to the second side wall 110 of the storage tote 100. The central ridge 116 bisects the base wall 104.

Without being bound to any particular theory, it is believed that bisecting the base wall 104 with the central ridge 116 provides for a greater structural integrity and increased durability of the base wall 104 relative to the prior art. Advantageously, the greater structural integrity and increased durability provided by the central ridge 116 militates against warping of the base wall 104 post-manufacturing.

Figure 6:
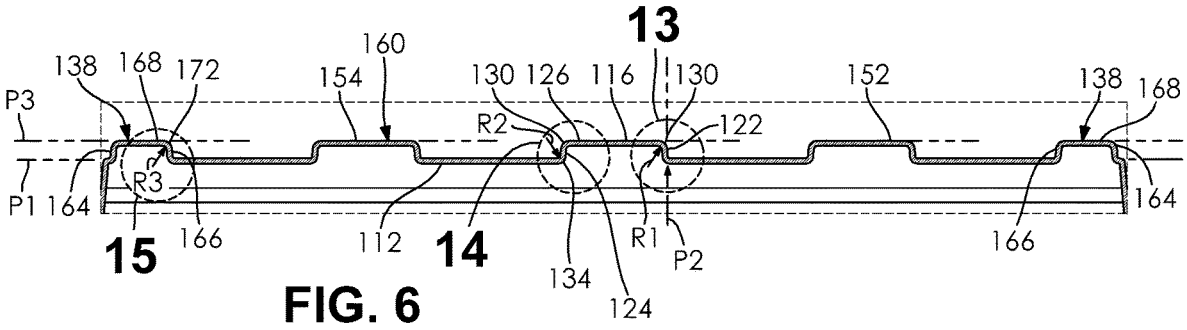
FIG. 6 is an enlarged, fragmentary, side elevational view of the storage tote taken at call-out 6 in FIG. 5.
Figure 7:
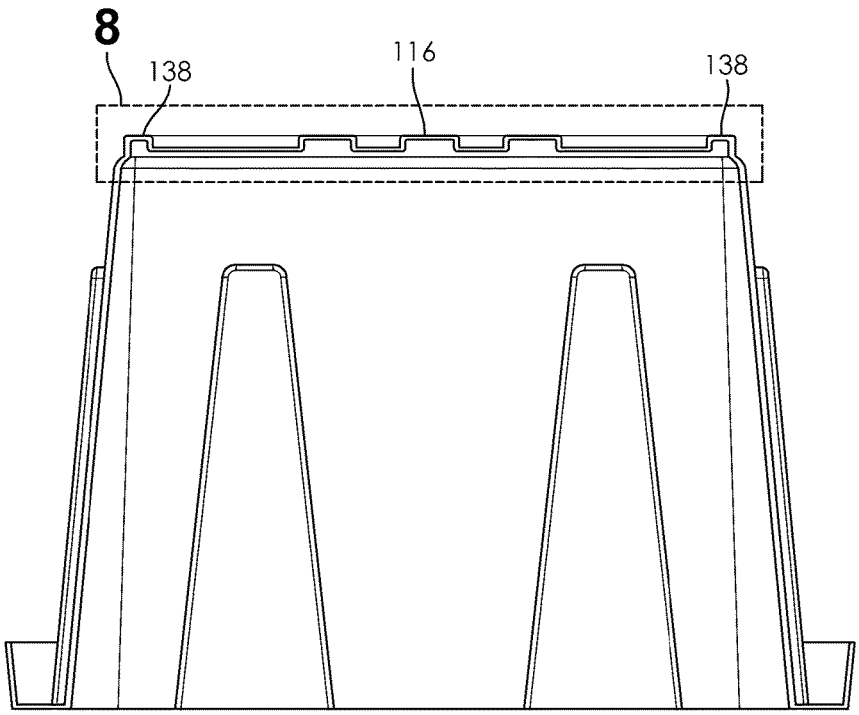
FIG. 7 is a cross-sectional, side elevational view of the storage tote taken at section line B-B in FIG. 3.
Figure 8:
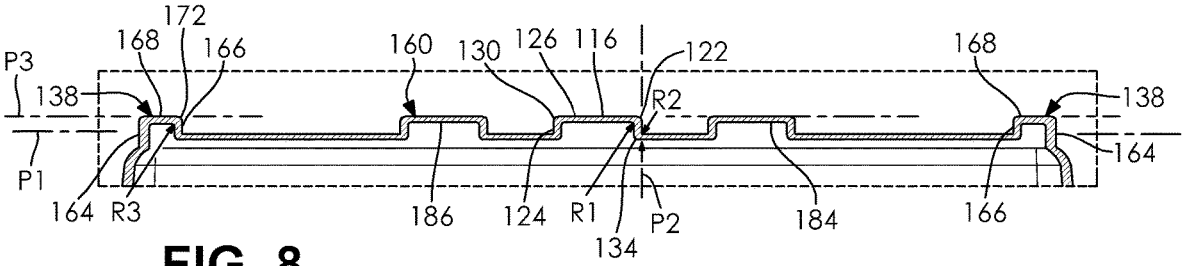
FIG. 8 is an enlarged, fragmentary, side elevational view of the storage tote taken at call-out 8 in FIG. 7.

Now referring to FIGS. 6 and 8, the central ridge 116 of the storage tote 100 may have a first wall 122, a second wall 124, and a third wall 126. The first wall 122 and is disposed on a second plane P2, and the second wall 124 is disposed on another plane oriented generally parallel with the second plane P2. The first wall 122 is spaced apart from the second wall 124. The third wall 126 of the central ridge 116 may be on a third plane P3. In particular, the bottommost or outer surface of the third wall 126 may be directly disposed on the third plane P3. The third wall 126 may be further disposed between and connected to the first wall 122 and the second wall 124 of the central ridge 116, to thereby form the central ridge 116 of the base wall 104.

Figure 13:
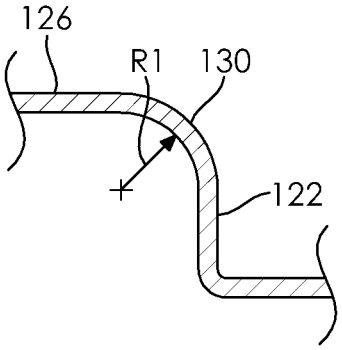
FIG. 13 is an enlarged, fragmentary, side elevational view of the storage tote taken at call-out 13 in FIG. 6.

In a particular example, as shown in FIG. 13, the third wall 126 may be further connected to each of the first wall 122 and the second wall 124 with a rounded corner 130. Advantageously, the rounded corner 130 has a first radius R1 that may provide greater structural durability and require less pressure to fill a mold during an injection molding process to form the storage tote 100. For example, the first radius R1 of the rounded corner 130 may be between 0.01 inches and 0.5 inches. In a more particular example, the rounded corner 130 may have a first radius R1 between 0.05 inches and 0.4 inches. In an even more particular example, the rounded corner 130 may have a first radius R1 between 0.1 and 0.3 inches. In a most particular example, the rounded corner 130 may have a first radius R1 of about 0.175 inches. A skilled artisan may select other suitable radii for the first radius R1, within the scope of the present disclosure.

Figure 14:
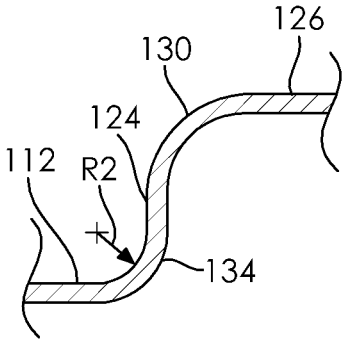
FIG. 14 is an enlarged, fragmentary, side elevational view of the storage tote taken at call-out 14 in FIG. 6.

In a specific example, as shown in FIG. 14, each of the first wall 122 and the second wall 124 may also be connected to the center area 112 of the base wall 104 with a rounded corner 134. Advantageously, the rounded corner 134 has a second radius R2 that may provide greater structural durability and require less pressure to fill the mold during the injection molding process to form the storage tote 100. For example, the second radius R2 of the rounded corner 134 may be between 0.01 inches and 0.3 inches. In a more specific example, the rounded corner 134 may have a second radius R2 between 0.02 inches and 0.2 inches. In an even more specific example, the rounded corner 134 may have a second radius R2 between 0.03 inches and 0.1 inches. In a most specific example, the rounded corner 134 may have a second radius R2 of about 0.05 inches. One skilled in the art may select other suitable radii for the second radius R2, within the scope of the present disclosure.

With reference to FIGS. 1-8, the main body 102 may further include an outer perimeter ridge 138. The outer perimeter ridge 138 may be disposed between the center area 112 of the base wall 104 and the plurality of side walls 106. Advantageously, the outer perimeter ridge 138 may provide more stability to the storage tote 100.

In a particular example, as shown in FIGS. 1-4, the first end 118 and the second end 120 of the central ridge 116 may be connected to the outer perimeter ridge 138. Advantageously, the storage tote 100 may have greater structural integrity where the first end 118 and the second end 120 of the central ridge 116 are connected to the outer perimeter ridge 138.

Figure 9:
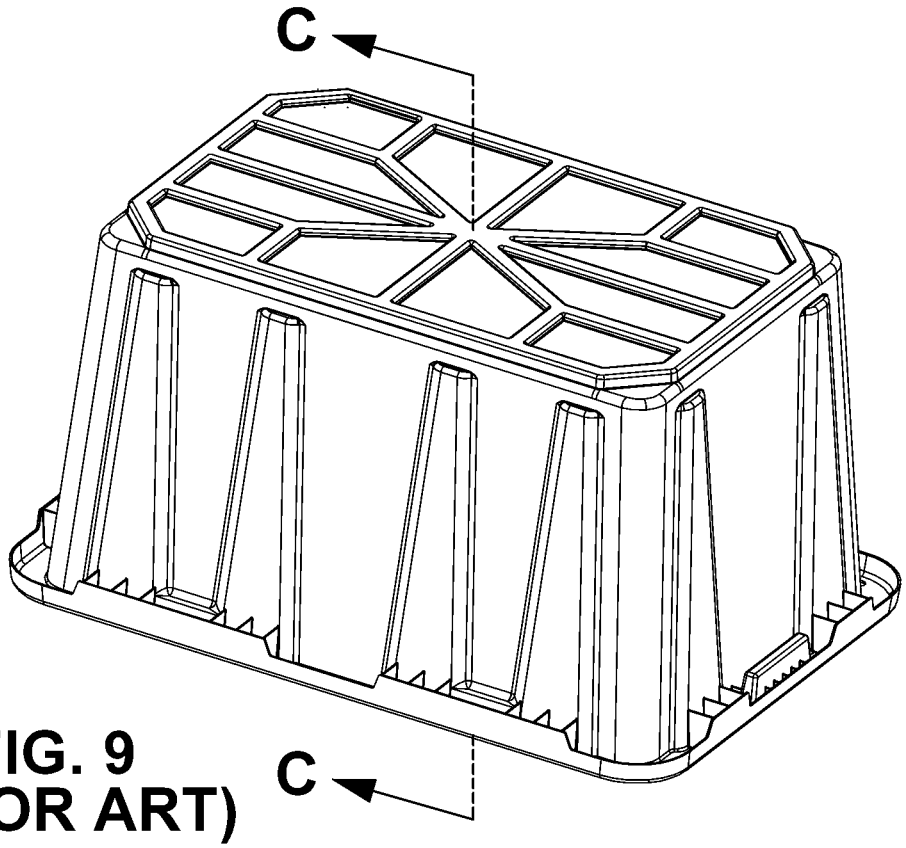
FIG. 9 (PRIOR ART)
FIG. 9 is a bottom perspective view of a prior art storage tote provided for the purpose of comparison to the storage totes of the present disclosure.
Figure 10:
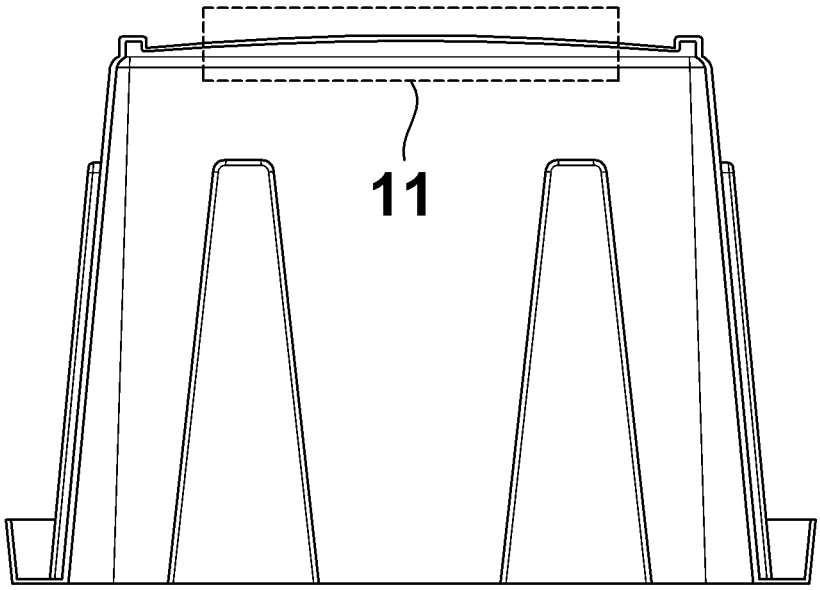
FIG. 10 (PRIOR ART)
FIG. 10 is a cross-sectional, side elevational view of the prior art storage tote taken at section line C-C in FIG. 9.
Figure 11:
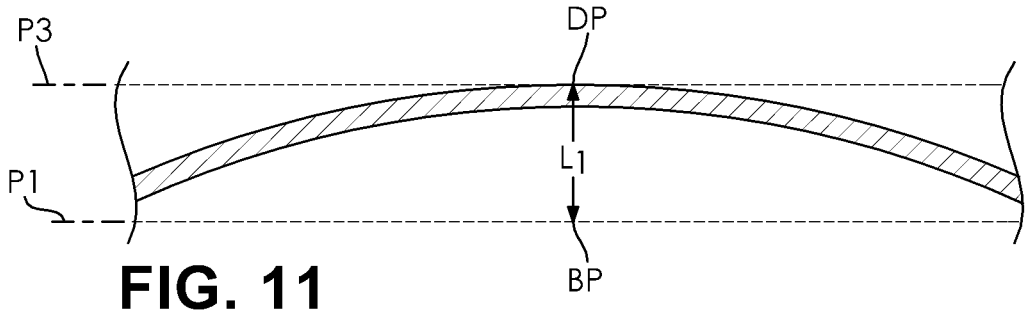
FIG. 11 (PRIOR ART)
FIG. 11 is an enlarged, fragmentary, side elevational view of the prior art storage tote taken at call-out 11 in FIG. 10, following an injection molding process to manufacture the same, and depicting a tolerance of deflection of a base wall in the prior art storage tote as manufactured.

As shown in the prior art of FIGS. 9-11, a storage tote of known designs will have a "tolerance of deflection" associated with the pressure and stress induced on the plastic materials during the injection molding manufacturing process. The tolerance of deflection, which is identified in FIG. 11 by "L1," may be defined as a distance between a baseline point BP on the first plane P1 and a deflection point DP on the third plane P3, and is a useful metric for the warping of the storage tote post-manufacturing. Each of the deflection point DP and the baseline point BP may be substantially centrally located adjacent the central area of the base wall. In some instances, the deflection point DP is at an apex of the base wall relative to the first plane P1. It should be appreciated that the baseline point BP is found at a hypothetical nominal location where there is no deflection of the base wall as manufactured. Additionally, the deflection point DP is found at a furthest location from the nominal location that is associated with deflection of the base wall following the manufacturing of the storage tote. The baseline point BP and the deflection point DP may therefore be used to determine the tolerance of deflection L1.

With respect to the prior art storage tote shown in FIGS. 9-11, the tolerance of deflection L1 may be acquired by measuring a distance between the baseline point BP and the deflection point DP. It is known that the tolerance of deflection associated with prior art storage totes post-manufacturing has typically been greater than about 0.15 inches, using conventional injection molding methodology.

Figure 12:
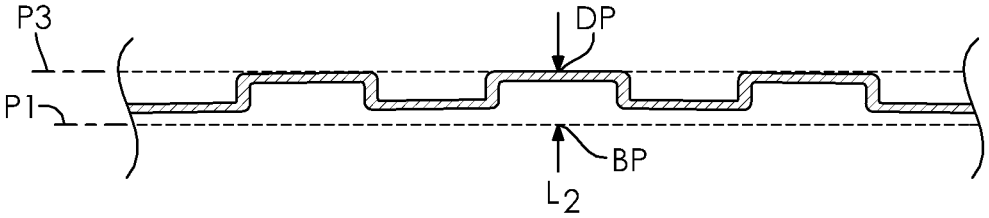
FIG. 12 is an enlarged, fragmentary, side elevational view of the storage tote taken at call-out 12 in FIG. 5, following an injection molding process to manufacture the same, and depicting a tolerance of deflection of a base wall of the storage tote as manufactured, the tolerance of deflection being superior to the tolerance of deflection shown in FIG. 11.

Advantageously, and as shown in FIG. 12, the base wall 104 of the storage tote 100 of the present disclosure has a tolerance of deflection L2 that is significantly less than the tolerance of deflection L1 associated with prior art totes. In particular examples, it has been found that the tolerance of deflection L2 for similarly sized storage totes is between thirty-three percent (33%) and fifty percent (50%) less than the tolerance of deflection L1 for prior art storage totes of similar overall size and dimensions. This important reduction in the tolerance of deflection of the base wall 104 of the storage tote 100 of the instant disclosure is realized in minimal warping and improved stackability and nesting of the storage tote 100 in operation.

As shown in FIG. 12, the storage tote 100 of the present disclosure has the tolerance of deflection L2. The first plane P1, on which the center area 112 of the base wall 104 of the storage tote 100 is arranged, may have the baseline point BP. The third plane P3, on which the bottommost or outer surface of the third wall 126 of the central ridge 116 is arranged, may have the deflection point DP. As with the prior art totes discussed hereinabove, the tolerance of deflection L2 is defined by the distance between the baseline point BP and the deflection point DP, and is a useful metric in determining the amount of warping of the base wall 104 following the injection molding manufacturing process for the storage tote 100.

In particular, and with continued reference to FIG. 12, the tolerance of deflection L2 for the base wall 104 of the storage tote 100 is less than 0.15 inches. In a more specific example, the tolerance of deflection L2 is between 0.07 inches and 0.11 inches. In an even more specific example, the tolerance of deflection L2 may be between 0.09 inches and 0.1 inches. In a most specific example, the tolerance of deflection L2 may be about 0.094 inches. It has been found that the tolerance of deflection L2 in these ranges results in a significant improvement in stackability and nesting of the storage totes 100, in operation, relative to the prior art storage totes as described and shown in FIGS. 9-11. Other suitable deflection tolerances may also be accepted by the skilled artisan, for example, based on the overall size and dimensions of the storage tote 100 being manufactured, within the scope of the present disclosure.

In another embodiment, as shown in FIGS. 1-2 and 5-6, the central ridge 116 may also include a first side ridge 152 and a second side ridge 154. With reference to FIG. 6, the first side ridge 152 may be spaced apart from the first wall 122 of the central ridge 116. The first side ridge 152 may further be oriented substantially parallel to the central ridge 116. The second side ridge 154 may also be spaced apart from the second wall 124 of the central ridge 116. Likewise, the second side ridge 154 may be oriented substantially parallel to the central ridge 116. One skilled in the art may select other suitable orientations and spacing of the first side ridge 152 and the second side ridge 154, within the scope of the present disclosure.

Without being bound to any particular theory, it is believed that providing the first side ridge 152 and the second side ridge 154, together with the central ridge 116, provides greater structural integrity and increased durability of the base wall 104. Advantageously, the greater structural integrity and increased durability provided by the first side ridge 152 and the second side ridge 154 militates against warping of the base wall 104 post-manufacturing.

Figure 5:
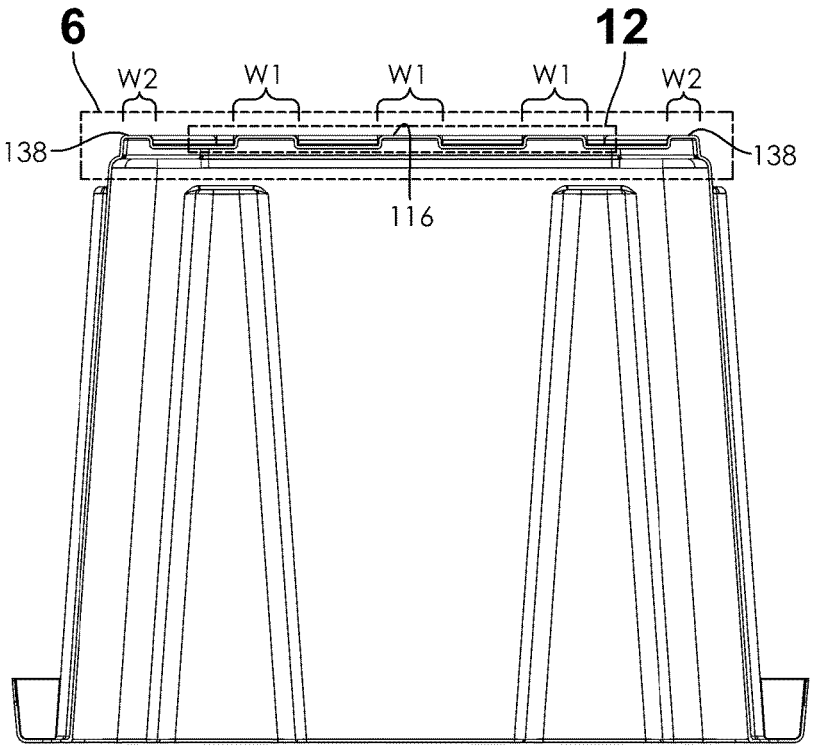
FIG. 5 is a cross-sectional, side elevational view of the storage tote taken at section line A-A in FIG. 1.

As shown in FIGS. 5-6, the spaced apart arrangement of the central ridge 116, the first side ridge 152, and the second side ridge 154 results in a corrugation of the base wall 104, which likewise provides a "corrugated effect." In a specific example, as shown in FIGS. 5-6, the first side ridge 152 and the second side ridge 154 may be substantially evenly spaced apart from the central ridge 116. However, a skilled artisan may select other suitable spacings for the central ridge 116, the first side ridge 152, and the second side ridge 154 across a width of the base wall 104, as desired.

Without being bound to any particular theory, it is believed that the positioning of the central ridge 116, the first side ridge 152, and the second side ridge 154 allow the base wall 104 of storage tote 100 to have enhanced structural integrity. This enhanced structural integrity of the base wall 104 allows the stress during the manufacturing process to be more evenly distributed along the base wall 104, for example, in a manner similar to a structural Roman arch. Advantageously, by evenly distributing the stress along the base wall 104, the storage tote 100 is more resistant to warping following the injection molding process. Desirably, the enhanced structural integrity also allows the storage tote 100 to have a more consistent appearance and shape after the manufacturing process and further increases the stacking quality of the storage tote 100.

Figure 2:
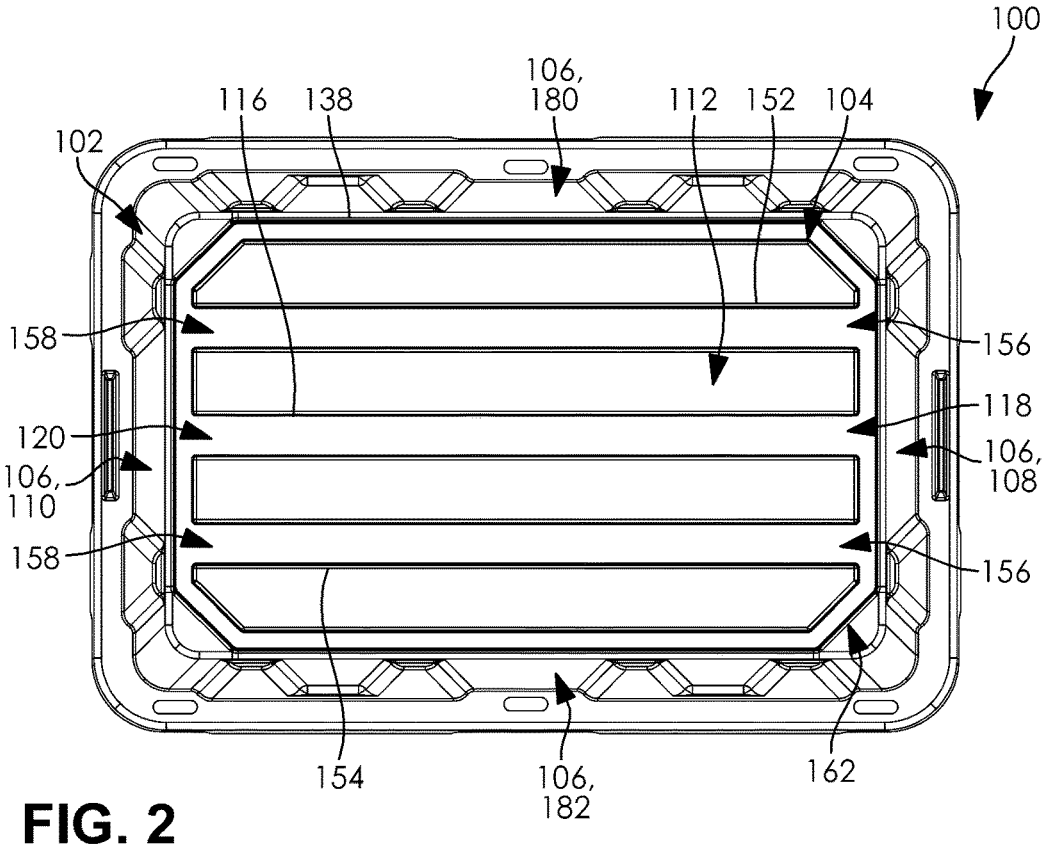
FIG. 2 is a bottom plan view of the storage tote shown in FIG. 1.

As shown in FIGS. 1-2, each of the first side ridge 152 and the second side ridge 154 may have a first end 156 and a second end 158. The first end 156 of each of the first side ridge 152 and the second side ridge 154 may be connected to the outer perimeter ridge 138 and further disposed adjacent to the first side wall 108 of the storage tote 100. The second end 158 of each of the first side ridge 152 and the second side ridge 154 may be connected to the outer perimeter ridge 138 and further disposed adjacent to the second side wall 110 of the storage tote 100.

In a particular example, the central ridge 116, the first side ridge 152, and the second side ridge 154 may be formed by injection molding. A skilled artisan may select other suitable methods of forming the central ridge 116, the first side ridge 152, and the second side ridge 154, within the scope of the present disclosure.

With reference to FIGS. 1-2 and 5-6, each of the central ridge 116, the first side ridge 152, and the second side ridge 154 may have a flat bottommost or outer surface 160. One skilled in the art may select other desirable formations of the bottom surface 160 of the central ridge 116, the first side ridge 152, and the second side ridge 154, within the scope of the present disclosure. Advantageously, the flat bottommost or outer surface 160 of each of the central ridge 116, the first side ridge 152, and the second side ridge 154 may increase the stability and stacking quality of the storage tote 100.

In another example, the outer perimeter ridge 138 further comprises at least one chamfered corner 162. Advantageously, the at least one chamfered corner 162 of the outer perimeter ridge 138 may enhance the stacking quality of the storage tote 100.

Figure 15:
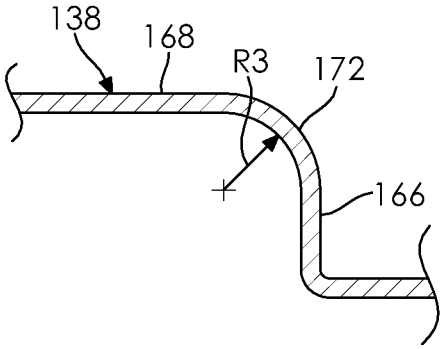
FIG. 15 is an enlarged, fragmentary, side elevational view of the storage tote taken at call-out 15 in FIG. 6.

In a specific example, as shown in FIGS. 6 and 8, the outer perimeter ridge 138 has a first surface 164, a second surface 166, and a third surface 168. The third surface 168 of the outer perimeter ridge 138 may be coplanar with the bottommost or outer surface 160 of the third wall 126 of the central ridge 116, and may likewise be disposed on the third plane P3. The first surface 164 and the second surface 166 of the outer perimeter ridge 138 may be disposed transverse to the third surface 168. As shown in FIG. 15, the third surface 168 of the outer perimeter ridge 138 may be further disposed between and connected to each of the first surface 164 and the second surface 166 of the outer perimeter ridge 138 with a curved corner 172. In a particular example, the curved corner 172 may have a third radius R3 between 0.01 inches and 0.5 inches. In a most particular example, the curved corner 172 may have a third radius R3 around 0.175 inches. It should be appreciated that the third radius R3 may facilitate a minimized warping of the base wall 104. A skilled artisan may select other suitable radii to form the third radius R3, within the scope of the present disclosure.

Now referring to FIGS. 6 and 8, the central ridge 116, the first side ridge 152, and the second side ridge 154 may each have a first width W1. The outer perimeter ridge 138 may have a second width W2. The first width W1 of each of the central ridge 116, the first side ridge 152, and the second side ridge 154 may be wider than the second width W2 of the outer perimeter ridge 138. Advantageously, the wider first width W1 of each of the central ridge 116, the first side ridge 152, and the second side ridge 154 may provide greater structural integrity of the storage tote 100. Desirably, the narrower second width W2 of the outer perimeter ridge 138 may provide enhanced stability to the storage tote 100 while minimizing the overall weight of the storage tote 100 due to the lesser width of the outer perimeter ridge 138.

In an alternative embodiment, as shown in FIGS. 3-4 and 7-8, the storage tote 100 includes a main body 102 having a base wall 104 with a first side ridge 152 and a second side ridge 154. The first side ridge 152 may further include a first central portion 184 spaced apart from the first wall 122 of the central ridge 116 and may be oriented substantially parallel to the central ridge 116. The second side ridge 154 may further include a second central portion 186 spaced apart from the second wall 124 of the central ridge 116 and may be oriented substantially parallel to the central ridge 116.

Each of the first side ridge 152 and second side ridge 154 may further have a plurality of end portions 188 oriented transverse to the central ridge 116. A skilled artisan may select other suitable configurations of the first side ridge 152 and the second side ridge 154, within the scope of the present disclosure.

Figure 3:
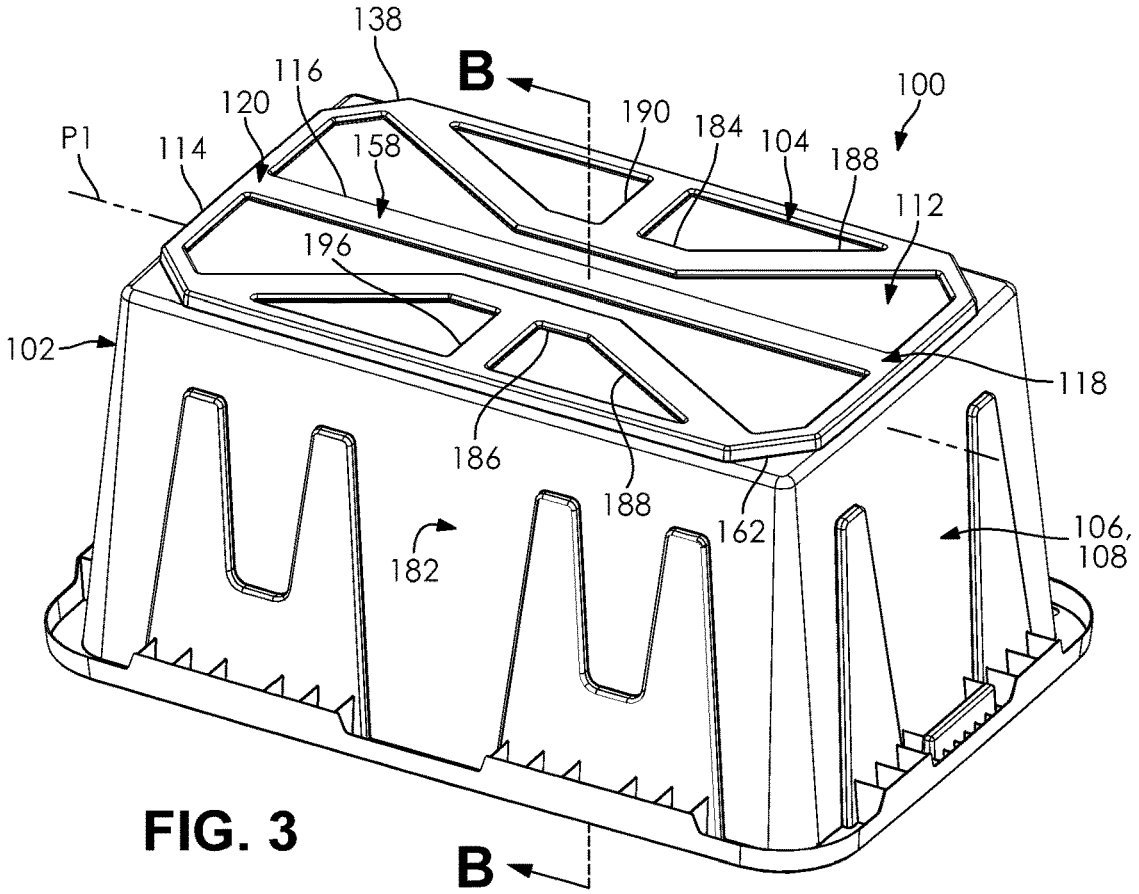
FIG. 3 is a bottom perspective view of a storage tote according another embodiment of the present disclosure.
Figure 4:
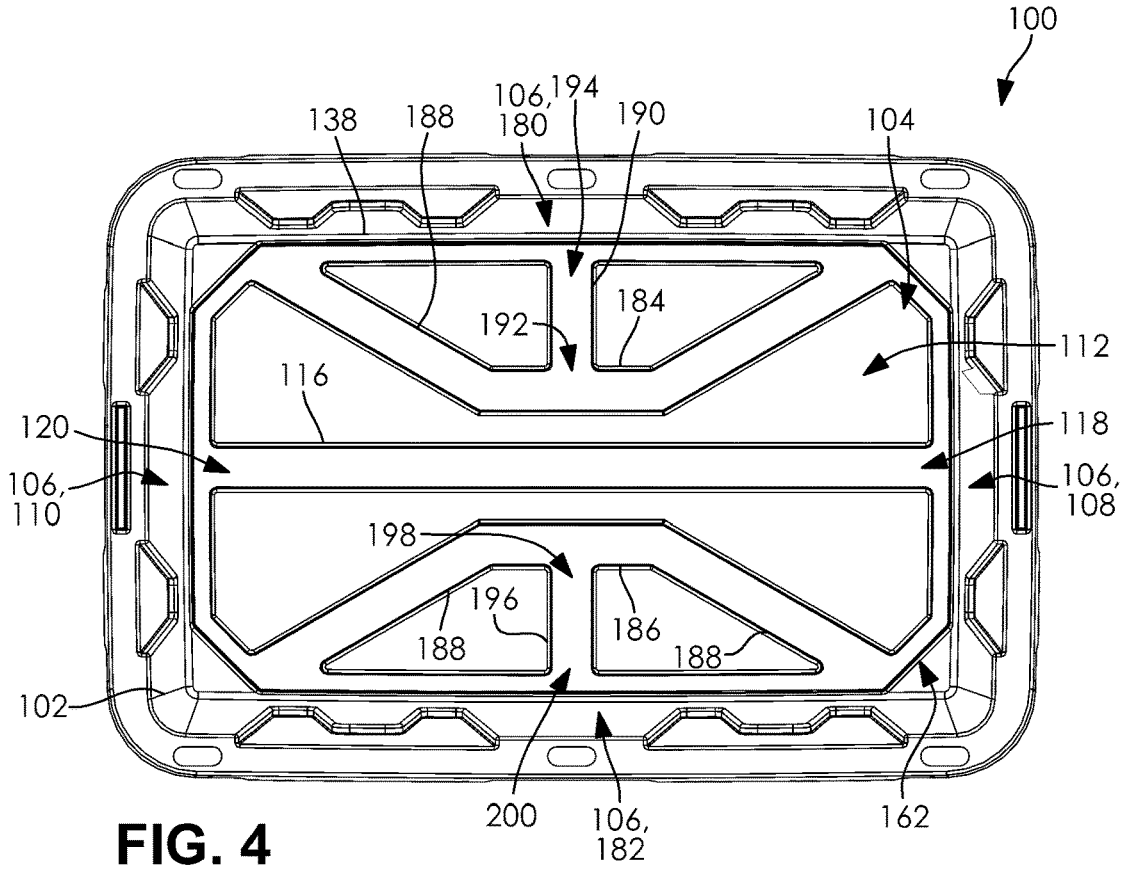
FIG. 4 is a bottom plan view of the storage tote shown in FIG. 3.

In a specific example, as shown in FIGS. 3-4, the first side ridge 152 may have a first lateral ridge 190 with a first end 192 and a second end 194. The second side ridge 154 may have a second lateral ridge 196 with a third end 198 and a fourth end 200. The first end 192 may be connected to the first central portion 184 of the first side ridge 152. The second end 194 may be disposed adjacent to the third side wall 180. The third end 198 may be connected to the second central portion 186 of the second side ridge 154. The fourth end 200 may be disposed adjacent to the fourth side wall 182.

Without being bound to any particular theory, it is believed that the positioning of the first lateral ridge 190 and the second lateral ridge 196 provides the base wall 104 of storage tote 100 with greater structural integrity and further militates against warping post manufacturing.

Advantageously, the configuration of base wall 104 of the storage tote 100 of the present disclosure militates against an undesirable inward flexing or warping at the center area 112 of the base wall 104. It has been found that the central ridge 116 of the storage tote 100 facilitates a more even distribution of the stress across the main body 102, which is believed to further militate against warping and deflection.

While certain representative embodiments and details have been shown for purposes of illustrating the invention, it will be apparent to those skilled in the art that various changes may be made without departing from the scope of the disclosure, which is further described in the following appended claims.

What is claimed is:

1. A storage tote, comprising:

a main body having a base wall, a plurality of side walls including a first side wall, a second side wall opposite the first side wall, a third side wall, and a fourth side wall opposite the third side wall, the base wall having a center area generally arranged on a first plane and bounded by the plurality of side walls, the base wall having an outer perimeter ridge extending outwardly from the center area, the outer perimeter ridge having a first portion, a second portion, a third portion, and a fourth portion, the first portion of the outer perimeter ridge being adjacent the first side wall, the second portion of the outer perimeter ridge being adjacent the second side wall, the third portion of the outer perimeter ridge being adjacent the third side wall, and the fourth portion of the outer perimeter ridge being adjacent the fourth side wall, the base wall further having a central ridge with a first end and a second end, the central ridge extending outwardly from the center area, the central ridge extending from the first end at the first portion of the outer perimeter ridge to the second end at the second portion of the outer perimeter ridge, the central ridge bisecting the main body, the central ridge from the first end of the central ridge to the second end of the central ridge forming a continuous, uninterrupted surface, wherein center area of the base wall further having a first side ridge and a second side ridge, wherein the central ridge has a first wall, a second wall, and a third wall, and the first wall is disposed on a second plane oriented transverse to the first plane, the second wall spaced apart from the first wall and oriented on a plane generally parallel with the second plane, and the third wall of the central ridge is disposed on a third plane oriented transverse to the second plane, the third wall disposed between and connecting the first wall and the second wall of the central ridge, wherein the first side ridge is spaced apart from the first wall of the central ridge, and the second side ridge is spaced apart from the second wall of the central ridge, wherein the first side ridge further has a first central portion and a pair of first end portions, the first central portion spaced apart from the first wall of the central ridge and oriented substantially parallel to the central ridge, the second side ridge further has a second central portion and a pair of second end portions, the second central portion spaced apart from the second wall of the central ridge and oriented substantially parallel to the central ridge, and each of first end portions and the second end portions oriented transverse to the central ridge, wherein the base wall has a first lateral ridge and a second lateral ridge, the first lateral ridge disposed between and connecting the first central portion of the first side ridge and the outer perimeter ridge, and the second lateral ridge disposed between and connecting the second central portion of the second side ridge and the outer perimeter ridge.

* * * * *